US005243963A

United States Patent [19]

Riener

[11] Patent Number: 5,243,963

[45] Date of Patent: Sep. 14, 1993

[54] FURNACE FOR SOLID FUELS, ESPECIALLY FOR PELLETS

[75] Inventor: Karl Riener, Micheldorf, Austria

[73] Assignee: Karl Stefan Riener, Micheldorf, Austria

[21] Appl. No.: 835,804

[22] Filed: Feb. 14, 1992

[30] Foreign Application Priority Data

Feb. 19, 1991 [AT] Austria ..... 349/91
May 16, 1991 [AT] Austria ..... 1014/91

[51] Int. Cl.[5] ..... F24H 9/18

[52] U.S. Cl. ..... 126/107; 126/68; 126/73; 110/190; 110/284

[58] Field of Search ..... 126/68, 73, 74, 75, 126/72, 70, 71, 99 R, 107; 110/190, 185, 267, 327, 101 R, 110

[56] References Cited

U.S. PATENT DOCUMENTS

| | | | |
|---|---|---|---|
| 2,694,489 | 11/1954 | Klijzing et al. | 126/73 X |
| 3,599,609 | 8/1971 | Sams et al. . | |
| 4,430,948 | 2/1984 | Schafer et al. | 110/101 R |
| 4,836,182 | 6/1989 | Trowbridge | 126/72 X |
| 4,922,889 | 5/1990 | Nuesmeyer et al. | 126/73 |
| 5,070,798 | 12/1991 | Jurgens | 110/110 |
| 5,103,742 | 4/1992 | Valentino | 110/185 X |
| 5,105,797 | 4/1992 | Glutzen et al. | 126/72 X |
| 5,133,266 | 7/1992 | Cullen | 110/110 X |
| 5,137,012 | 8/1992 | Crossman, Jr. et al. | 126/73 X |
| 5,144,941 | 9/1992 | Saito et al. | 431/350 X |
| 5,148,798 | 9/1992 | de Kock | 110/327 X |

FOREIGN PATENT DOCUMENTS

| | | |
|---|---|---|
| 10394 | 1/1903 | Austria . |
| 164842 | 12/1949 | Austria . |
| 255073 | 6/1967 | Austria . |
| 87306 | 6/1896 | Fed. Rep. of Germany . |
| 348686 | 2/1922 | Fed. Rep. of Germany . |
| 585289 | 9/1933 | Fed. Rep. of Germany . |
| 10917 | 10/1895 | Switzerland . |
| 3276 | of 1899 | United Kingdom . |

OTHER PUBLICATIONS

German OS 1,554,705 May 1969.

*Primary Examiner*—Larry Jones
*Attorney, Agent, or Firm*—Kurt Kelman

[57] ABSTRACT

A furnace for solid fuels is especially for pellets. This furnace includes a combustion chamber, a holder pan for the combustion material positioned in the combustion chamber, and a combustion material transport device located between the holder pan and a fuel container for combustion material. The combustion chamber is surrounded by a convection space, which is closed off towards the outside by a convection mantle, with a blower arranged between the ambient air and the convection space, if necessary. A flue gas blower is arranged between the combustion chamber and a flue gas line. A flue gas channel is arranged in front of at least one rear wall of the combustion chamber on the side facing away from the combustion chamber. This channel extends over at least part of a width and a height of the combustion chamber. At the upper end region of the flue gas channel, which region faces a cover plate, the combustion chamber is connected with at least one opening connecting this channel with the combustion chamber, and in the opposite end region, which region faces a base plate, it is connected with a flue gas outlet, preferably with the involvement of a flue gas blower, via at least one suction opening. A heat exchanger is arranged in the flue gas channel, with fresh air flowing through it in a manner which is countercurrent to the flow direction of a flue gas.

44 Claims, 12 Drawing Sheets

Fig.5
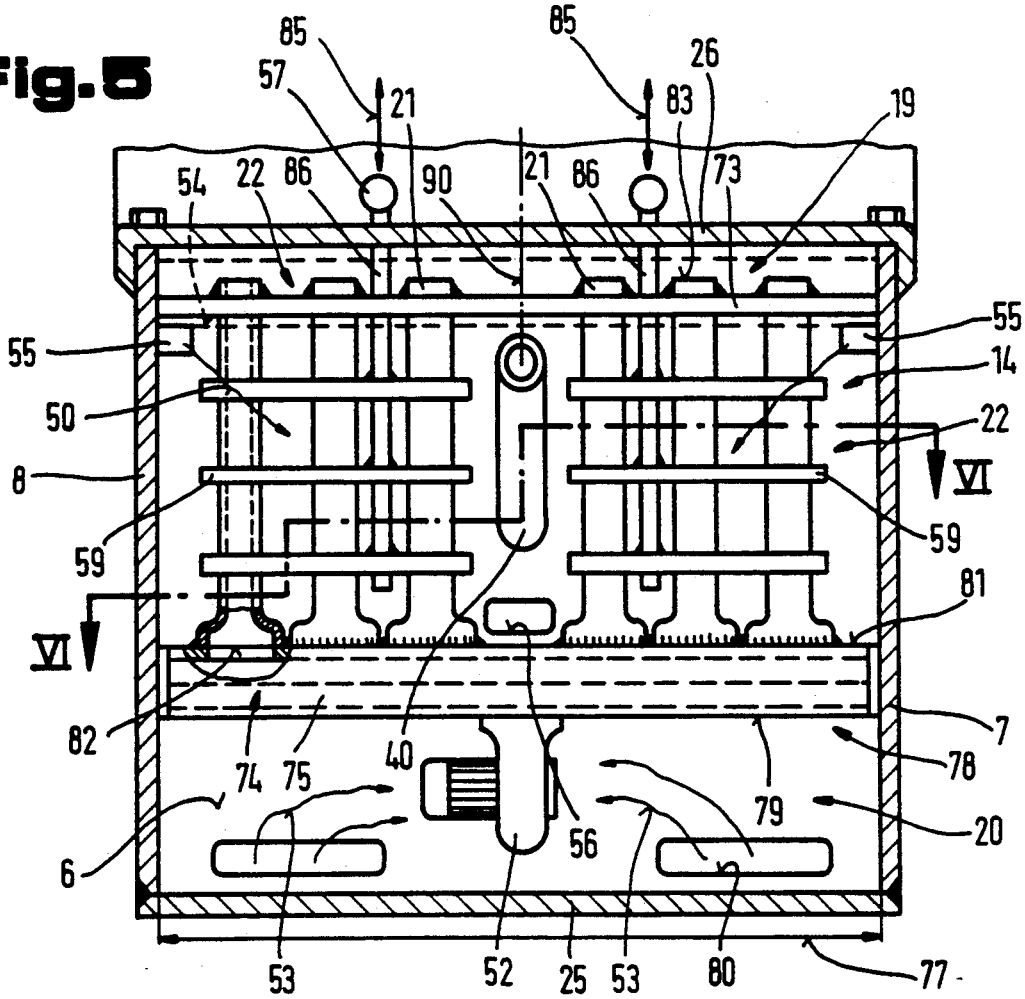
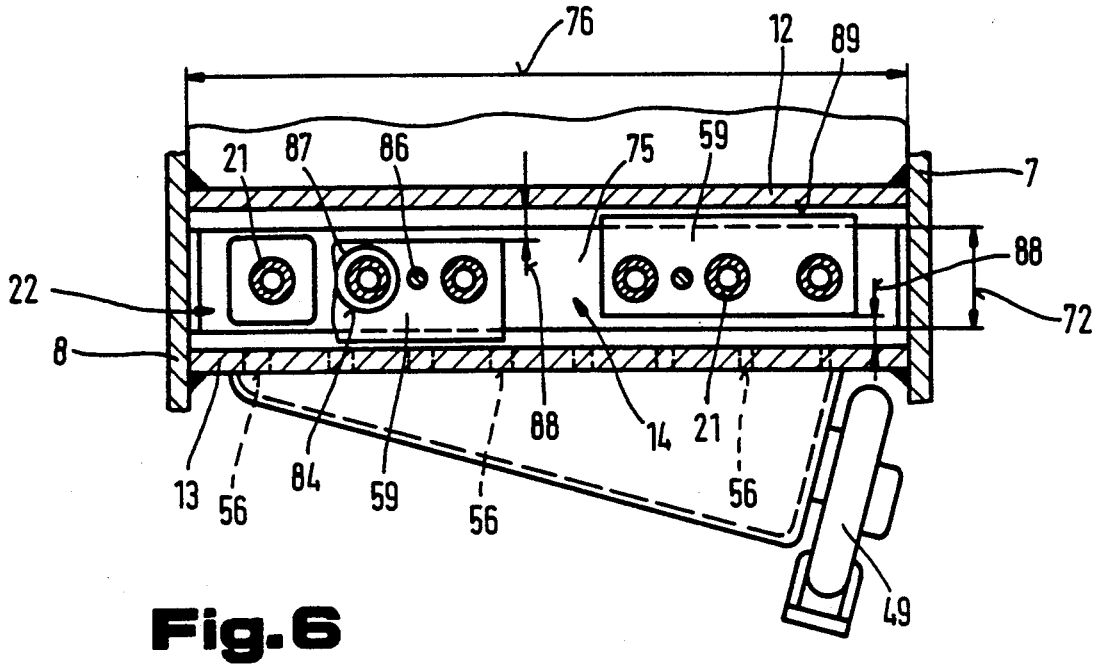
Fig.6

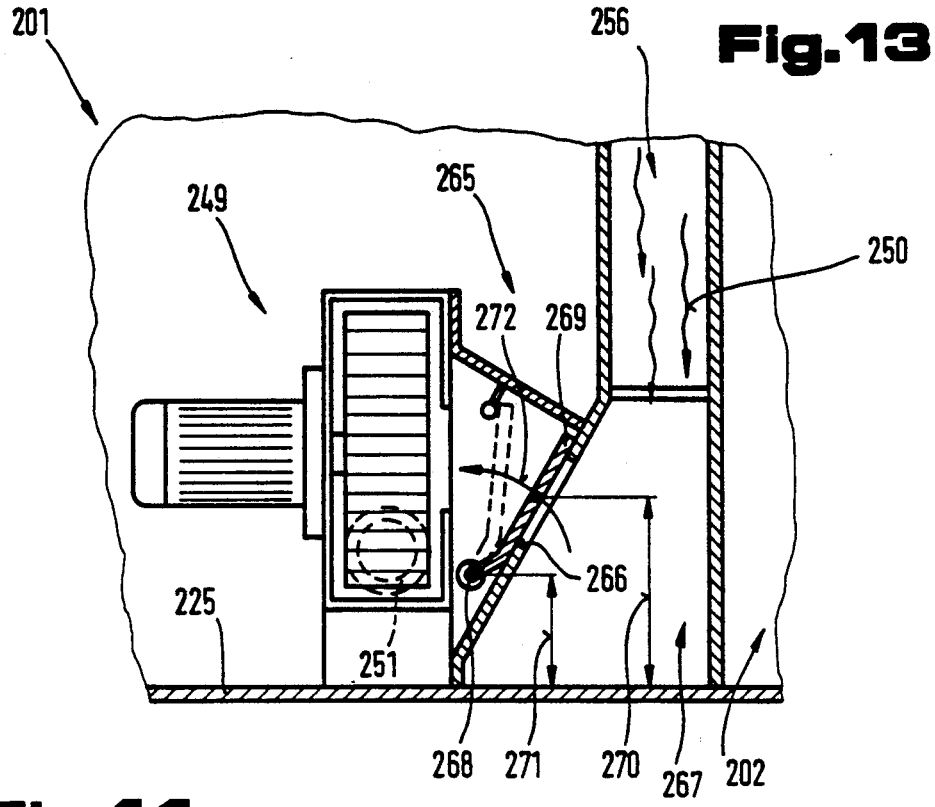
Fig.13
Fig.14
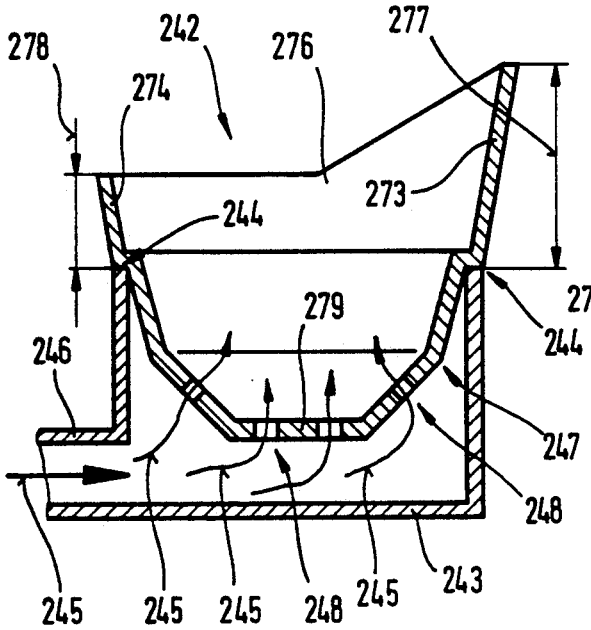
Fig.15
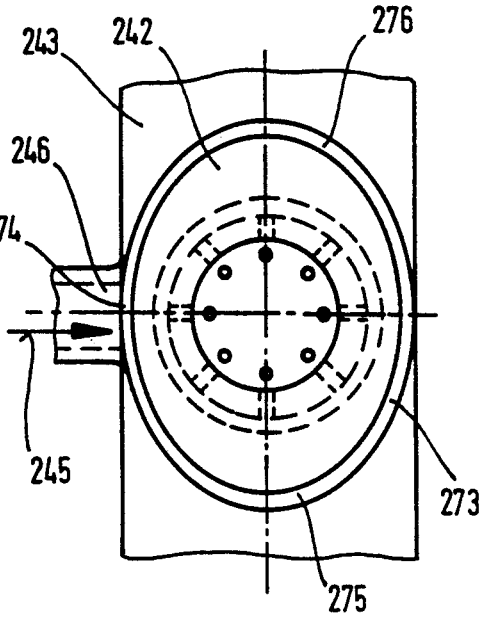

FURNACE FOR SOLID FUELS, ESPECIALLY FOR PELLETS

BACKGROUND OF THE INVENTION

1. Field of the Invention

The present invention relates to a furnace for solid fuels, and especially pellets.

2. The Prior Art

Known furnaces for solid fuels include a burner pan arranged in a combustion space and a transport device for the combustion material, and structured from a fuel container in the combustion space and a convection space for circulating air operation by means of a blower and a flue gas blower can be designed for burning wood or fuels similar to wood. In other words, furnaces containing fuels with low caloric value, could only be used to a limited degree as continuous heaters to give off uniform heating energy in the form of radiation or convection heat, in contrast to furnaces designed for burning coal or coke. The control procedures during operation of these furnaces, required by the devices for fuel and fresh air feed due to the changing operating conditions, take place by continuous monitoring of these furnaces and automatic intervention for purposes of regulation. With this, unsupervised operation of these furnaces is possible in many cases, but the energy utilization and the operational reliability are not satisfactory.

Furthermore, such furnaces for solid fuels are used as continuous heaters to give off heat by radiation and also heat by convection in many cases. The adjustment of these furnaces under changing conditions requires control procedures and elements for fuel feed of the primary and secondary air, i.e. the exhaust air, which makes constant monitoring of the operating status, especially the fuel feed, necessary, in order to prevent overheating of the combustion space, or to prevent the fire from going out.

SUMMARY OF THE INVENTION

It is an object of the present invention to provide a furnace with a high degree of effectiveness for the conversion of the energy contained in the fuel for use in interior heating, as well as a combustion space with a fuel container and an exhaust air system for flue gases, with a sensitive central control, which furthermore demonstrates great operational reliability.

The above object is accomplished by a furnace for solid fuel combustion material comprising a combustion chamber having at least one rear wall, and having a width and a height; a holder pan for the combustion material located in the combustion chamber; a transport device for the combustion material between the holder pan and a fuel container for the combustion material; means defining a convection zone surrounding the combustion chamber, which is closed off towards the outside by a convection mantle; a blower arranged between the ambient air and the convection zone; a flue gas blower positioned between the combustion chamber and a flue gas line; a flue gas channel located in front of said at least one rear wall of the combustion chamber on the side facing away from the combustion chamber, and extending over at least part of a width and a height of the combustion chamber; a cover plate and a base plate; said flue gas channel having an upper end region, and at said upper end region of the flue gas channel, which region faces said cover plate, is connected with at least one opening connecting said flue gas channel with the combustion chamber; and said flue gas channel having a lower end region, and in the lower end region, which lower end region faces said base plate, said flue gas channel is connected with a flue gas outlet, which is connected to said flue gas blower via at least one suction opening; and a heat exchanger located within said flue gas channel, with fresh air flowing through said heat exchanger in a direction countercurrent to the flow direction of a flue gas.

The surprising advantage of the present invention lies in the fact that the specific structure of such a furnace can be used to significantly increase the heat emission, i.e. the heat transfer between the flue gases and the fresh air intended for heating the rooms to be heated, with simple means, without complicated additional technical devices being required for this. At the same time, however, the operational reliability of such a furnace is significantly increased in an advantageous manner, since the temperature of the flue gases discharged from the furnace can be additionally increased with this intermediate positioning of the heat exchanger, and an additional insulating effect between the combustion space and the holder container in which the fuel is stored is achieved. At the same time, however, the degree of effectiveness of such a furnace is also increased, without additional fuel expenditure.

A further embodiment provides a blower for the fresh air, which allows the temperature of the incoming fresh air required for a comfortable living space atmosphere to be controlled in simple manner.

Another embodiment has a heat exchanger with hollow profiles which are arranged to run parallel to one another and through which fresh air flows. This is advantageous, since in this way, the danger of mixing of the heated fresh air passed into the space and of the flue gases is reliably prevented.

In a further embodiment, the pipes of the heat exchanger have a cross-section widened approximately to a square. This is advantageous in that because the cross-section becomes smaller in the direction of the exit side end, the flow rate of the fresh air to be heated increases in those regions in which the flue gases have a higher temperature. Thus, more intense heat transfer takes place, which achieves a more uniform heat transfer between the flue gases and the fresh air.

In another embodiment, the heat transfer between the flue gases and the fresh air is carried out in which the structure of the pipes of the heat exchanger is formed of a copper alloy, stainless steel, or a nickel-plated metal surface.

In a further embodiment, the heat exchanger has a flue gas guide device. This provides a more intensive heat transfer from the heated flue gases to the surface of the part of the heat exchanger through which fresh air flows. Thus, the temperature changes which result from the differing amounts of heat released during the combustion process can be equalized.

In another embodiment, the flue gas guide plates are formed with scratcher elements of a cleaning device for the heat exchanger. This makes it possible to use the cleaning devices necessary for keeping the surfaces of the heat exchanger clean, in order to achieve an advantageous heat transfer, for an improved energy exchange between the flue gases and the heat exchanger, at the same time.

In a further embodiment, an air guide device is provided. This enables an improved circulation and faster warming of the room air to be achieved.

In another embodiment, the arrangement of an additional air guide channel for the fresh air feed causes a targeted reduction of the very hot temperatures at the combustion space track, while simultaneously reducing radiation losses, and achieving the best possible utilization of the energy for heating the fresh air passed in for room heating. Furthermore, it is possible to reduce the stress on temperature-sensitive machine parts with this step-by-step temperature reduction and the arrangement of such an air guide channel for fresh air.

In a further embodiment, an overflow channel for the flue gas is provided. This structure is also advantageous, since with this, the fresh air which was already heated can be heated to a much higher temperature once more just before it exits, by passing by a wall of the over-flow channel directly before exiting into the room. This can prevent an air blockage or vortex in the convection shaft which runs approximately horizontally below the cover plate, if necessary.

In another embodiment, there is an overflow channel, which overflow channel can also be installed later, or retrofitted into an existing furnace.

In a further embodiment, there is an L-shaped profile connected with the cover plate as a guide device for the flue gas. This results in forced guidance of the flue gases along the rear wall of the combustion space into the region of the upper limit of the combustion space, which results in an additional heat transfer to the rear wall and the heat exchanger which is connected with the rear wall.

In another embodiment, there is a J-shaped profile projecting in the direction of the fire space doors. With the structure, the shielding of the glass panes placed in the doors is achieved, and thus, contamination of the glass panes with soot particles from the flue gas is avoided.

In a further embodiment, perforations are arranged in the cover plate in the region of the fire space doors. This achieves a cleansing and rinsing process in the form of a fresh air curtain in front of the glass panes, to keep them cool and to keep them clean.

In another embodiment, an adjustment device is provided for the J-shaped profile. This makes it possible to adjust the method for pane rinsing and cleansing as a function of the draft conditions in the combustion space.

In a further embodiment, a heat shield is arranged in front of the glass pane of the fire space doors. This prevents overheating of the standing surface of the furnace directly in front of the furnace.

In another embodiment, sensors with sensor elements, such as a thermocouple, are utilized. Thus, the volumetric throughput of the air for the furnace is continuously monitored, in order to regulate the furnace by intervention in the process to maximize the energy utilization.

In a further embodiment, there is a sensor element formed by a heated resistor arranged in an air line for the feed of fresh air to a fireplace. This allows simple and cost-effective regulation of the amount of air fed in, via the cooling of a sensor element caused by the flow speed of the air.

In another embodiment, the output of the flue gas blower is controlled by a regulation device based upon a temperature comparison. Due to this, the fresh air feed to the combustion space can be adjusted, in simple manner, by changing the output of the flue gas blower.

In a further embodiment, a measurement device in a control and regulation device is assigned to the sensors. Thus, the values determined by the sensors can be compared with reference values for carrying out automatic regulation functions.

In another embodiment, the flue gas blower and the screw conveyor are so structured that their speed of rotation is infinitely adjustable. This achieves regulation adapted to the output requirements in each case.

In a further embodiment, a plurality of connection openings are located between the combustion chamber and the flue gas channel. This achieves a uniform air and flue gas circulation in the combustion chamber and therefore an equalization in the surface heating due to the different temperature stresses in the combustion chamber.

In another embodiment, there are connection openings arranged in the region of the heat exchanger pipes. This achieves a higher degree of effectiveness of the heat exchanger.

In a further embodiment, an air shaft is arranged in the flue gas channel. Thus, the fresh air flowing towards the combustion chamber is pre-heated while it flows through the air shaft arranged in the flue gas channel. Hence, the degree of effectiveness is advantageously affected, especially at very low temperatures of the fresh air.

In another embodiment, the flue gas channel surrounds the combustion chamber and has a U-shape. Thus, a very high percentage proportion of the surface of the combustion chamber is utilized for heat energy transfer from the flue gas to the convection air.

In a further embodiment, several heat exchanges are arranged and a common blower for fresh air is provided. Thus, a very differentiated regulation, adapted to the operating conditions in each case, is achieved for the output of the energy conversion in the fireplace and the heat transfer in convection operation.

In another embodiment, the U-shaped flue gas channel is formed by several shafts separated from one another, and with a flue gas blower for each channel. Thus, a uniform surface temperature of the mantle surrounding the combustion chamber can be achieved even with disadvantageous cross-sectional dimensions of the combustion chamber, e.g. with a side ratio of width to depth greater than 2.

In a further embodiment, a primary air line in the combustion chamber opens into a holder chamber. Thus, a uniform and complete combustion of the fuel is achieved in the entire output range of the furnace by a burner pan set into a holder chamber for the fresh air via sealing surfaces and perforations in surface regions of the burner pan for primary air. Also, there is a pressure regulation device between the combustion chamber and the flue gas blower. Furthermore, with the pressure regulation device, a difference in vacuum between the combustion chamber and the air intake side of the fan is automatically adjusted as a function of the fan output of the exhaust air blower, causing the operating conditions to be maintained constant.

In another embodiment, the cross-sectional area of the perforations of the burner pan becomes smaller with decreasing distance to the sealing surface. Thus, a differentiated feed of combustion air into the bulk cone of the fuel, especially the pellets, is achieved.

In a further embodiment, the perforations are evenly distributed over the surface region of the burner pan facing the holder chamber. Thus, the base surface of the fuel cone has a uniform flow of primary air coming toward it.

In another embodiment, the perforations in the base plate of the burner pan are larger than the perforations in the side walls of the burner pan. Thus, a greater flow rate of air is achieved at the base surface of the fuel cone than at the side surfaces.

In a further embodiment, the base plate of the burner is at a slant to the vertical surface of the furnace. Thus, due to the conical structure of the air channel in the flow direction of the primary air, the flow velocity of the primary air is increased in the direction of the openings farther away from the entry point of the primary air. Therefore, a higher flame profile is achieved in this region, which faces the front doors.

In another embodiment, the end plate of the holder chamber and the base plate of the burner pan are parallel to each other, and are positioned at a slant to a vertical surface of the furnace. Thus, the burner pan is inclined in the direction of the ejection chute for the fuel, which achieves uniform fuel distribution in the burner pan.

In a further embodiment, the burner pan comprises a deflector wall, an intake opening for the fuel, cross walls delimiting the deflector wall, and a rear wall. Thus, the feed of the primary air is into the base of the fuel cone, thus, uniform burning of the fuel is achieved.

In another embodiment, the deflector wall of the burner pan projects beyond the rear wall. This results, overall, in a more concentrated accumulation of the fuel in the burner pan and thus in a smaller surface for the fuel cone. With this arrangement, particularly good long-term burning behavior of the furnace is achieved.

In a further embodiment, the height of the deflector wall, the rear wall, and the cross wall is different for each wall. Thus, it is possible to charge the burner pan with the fuel, with the pieces of fuel not getting outside of the burner pan, which makes it possible to prevent uncontrolled burning of pieces of fuel.

In another embodiment, the burner pan has a circular cross-section in a plane running parallel to the base plate. Thus, the burner pan is sealed efficiently and very accurately with its sealing surface, as well as with the sealing surface of the holder chamber. This is necessary to prevent a back flow of air from the combustion chamber into the burner pan.

In a further embodiment, the deflector wall, the rear wall, and the cross walls of the burner pan are oval or elliptical in cross-section. This results, overall, in a larger flame surface, adapted to the cross-sectional shape of the combustion chamber, and thus in a higher degree of efficiency of the furnace.

In another embodiment, the channels for the flue gas are arranged between the combustion chamber and a collector channel of the pressure regulator device. Thus, the flue gases are collected in the flue gas chamber and passed to the flue gas blower and the exhaust air channel via the pressure regulation device which regulates the amount of vacuum.

In a further embodiment, the pressure regulation device is formed by a flap forming a tight seal over an opening of a partition of the collector channel, which flap is pivotable. Thus, only a few components which are easy to manufacture are required.

In another embodiment, the flap has an incline relative to the base plate. This achieves a deflection of the flue gases, with an advantageous effect on flow, by the flue gas chamber and the pressure regulation device.

In a further embodiment, the flap takes an angle of less than or equal to 90° relative to the base plate. Thus, an automatic response of the burner flap is achieved by means of gravity.

In another embodiment, the center of gravity of the flap from the base plate is higher in the open position than in the closed. Thus, a non-linear control curve for the pressure regulation device is achieved, which is adapted to the performance curve of the furnace.

In a further embodiment, the flap or partition has a sealing device. Thus, no additional components are required to achieve a non-linear control curve for the pressure regulation device.

In a further embodiment, the pressure regulation device forms a blocking element for the exhaust gas line, at the same time.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only and not as a definition of the limits of the invention.

In the drawings, wherein similar reference characters denote similar elements throughout the several views:

FIG. 5 shows a cross-section view along lines V—V of FIG. 3 of the furnace according to the invention equipped with a heat exchanger;

FIG. 6 shows a cross-section along the lines VI—VI in FIG. 5 of the heat exchanger arranged in the flue gas channel of the furnace according to the invention;

FIG. 13 shows a cross-section of a pressure regulation device of the furnace according to the invention;

FIG. 14 shows a cross-section view of a burner pan of the furnace according to the invention; and FIG. 15 shows a top view of the burner pan of FIG. 14.

DETAILED DESCRIPTION OF PREFERRED EMBODIMENTS

Figure 1:
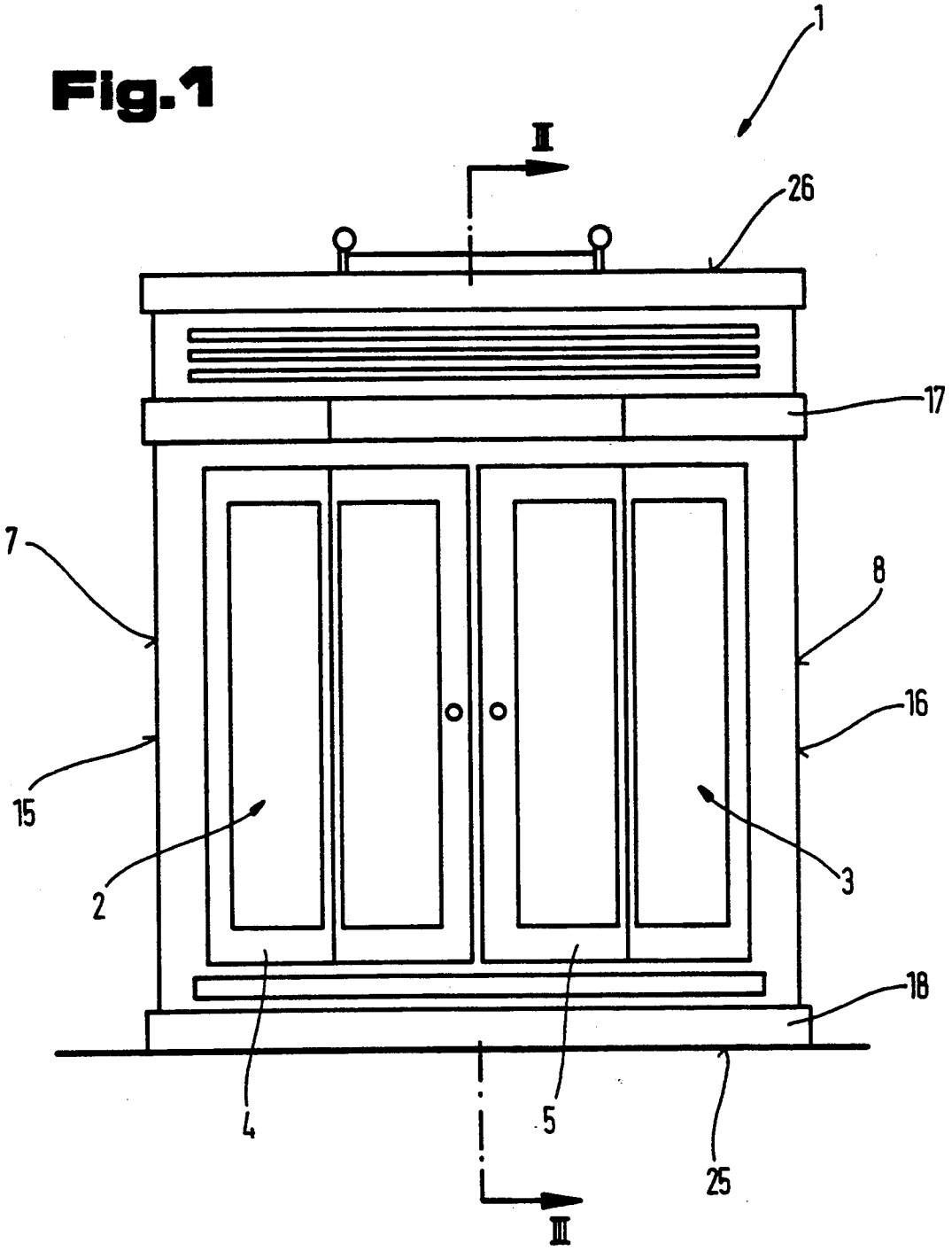
FIG. 1 shows a front view of a furnace according to the invention.
Figure 2:
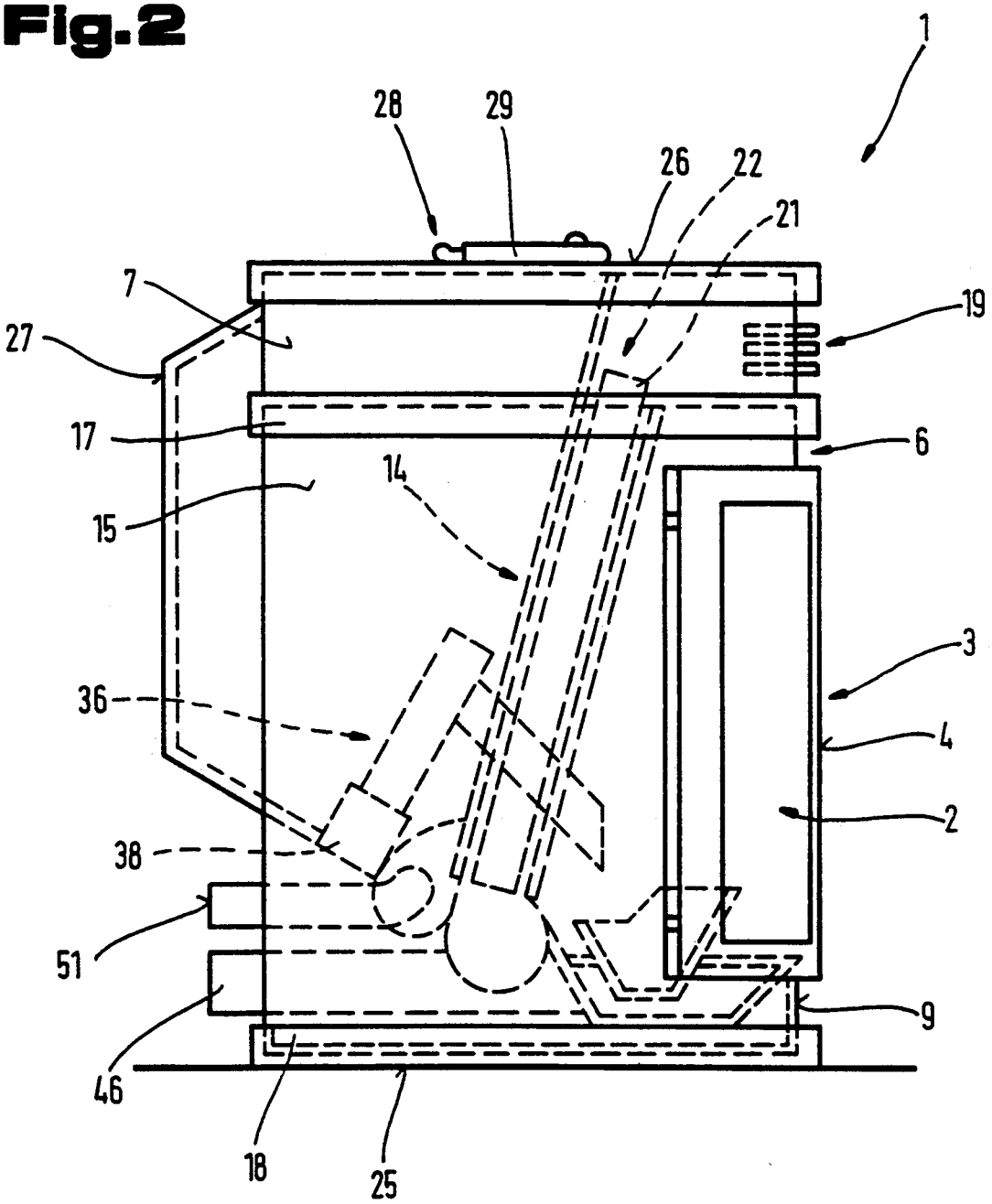
FIG. 2 shows a side view of the furnace of FIG. 1.
Figure 3:
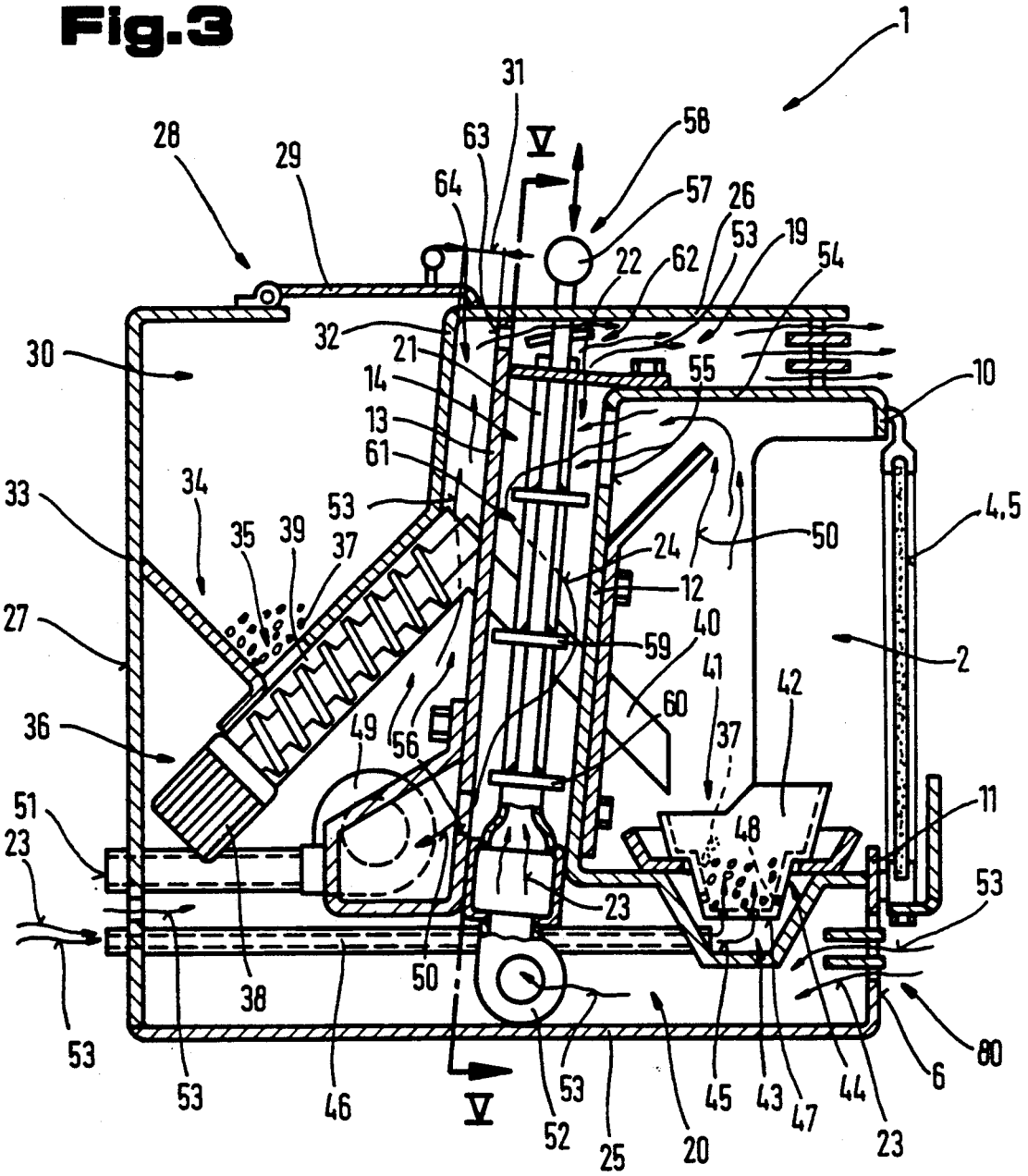
FIG. 3 shows a cross-section of the furnace according to the invention along the lines III—III of FIG. 1.

Turning now in detail to the drawings, FIGS. 1 to 4 show a furnace 1 which has a combustion chamber 2, which is accessible via an operating and/or cleaning opening 3, which can be closed off via fire space doors 4, 5. The operating and/or cleaning opening 3 is arranged in a front wall 6 of a one-piece component 9 which preferably also forms side walls trapezoidal or C-shaped cross-section and assembly strips 10, 11 running parallel to the front wall 6. The combustion chamber 2 is furthermore closed off by a rear wall 12. At a distance in the opposite direction to the fire space doors 4, 5 from the rear wall 12, a rear wall plate 13 of the convection mantle is attached, which delimits a flue gas channel 14 together with the side walls 7, 8. In the region of the side walls 7, 8, the convection mantle or zone is formed by paneling elements 15, 16, which are arranged between stop strips 17, 18. Above the combustion chamber 2, a convection shaft or tunnel 19 is arranged, and below the combustion chamber 2, an in-flow space or tunnel 20 for convection air is arranged. In the flue gas channel 14, a heat exchanger 22 formed of pipes 21, forming a flow connection between the convection tunnel 19 and the in-flow tunnel 20, is arranged, in which ambient air which flows through it (Arrow 23) is heated by a flue gas which flows around the pipes 21 (Arrow 24).

A further structural characteristic of the furnace 1 is formed by a base plate 25, a cover plate 26 and a rear 27. At the cover plate 26, a charging flap 29, which forms the vertical delimitation of the furnace 1 and can be flipped open via a hinge arrangement 28, is arranged, which covers the fuel container 30 in the closed state. The fuel container 30 is formed by a container wall 32 connecting the side walls 7, 8 of the furnace 1 and located at a slight distance 31 in front of the rear wall plate 13, and container walls 33. With this, the flue gas channel 14 is located between the combustion chamber 2 and the fuel container 30.

A base region 34 of the fuel container 30 is V-shaped and structured to narrow in the direction of the base plate 25, which causes a gravity slide to be formed in the direction of an intake opening 35 for a screw conveyor 36 approximately at the deepest point of the base region 34. This conveyor particularly transports a fuel 37 in particle form, e.g. pellets, with a screw 39 driven by a drive motor 38, in the direction of a pipe-shaped ejection chute 40. The ejection chute 40 is arranged at a slant in the direction of the combustion chamber 2, and projects through the rear wall plate 13 and the rear wall 12. This causes the fuel 37 to slide down in the ejection chute 40 under the effect of gravity, after it has reached the highest point of the screw conveyor 36, and to be passed to the combustion chamber 2 and held within a burner pan 42 which forms the fireplace 41.

The burner pan 42 is inserted in a sealing arrangement 44 in a holder chamber 43. The holder chamber 43 is connected with the ambient air (Arrow 23) via an air line 46 which extends in the direction of the rear 27, for feed of combustion air (Arrow 45). The combustion air (Arrow 45) flows into the fireplace 41 via perforations 48 distributed in the surface regions 47 of the burner pan 42 facing the holder chamber 43, and flows around the particulate fuel 37. The flue gas is drawn off with a flue gas blower 49, and a partial vacuum is generated in the combustion chamber 2, causing the feed of combustion air (Arrow 45) to necessarily be increased. A change in the speed of rotation of the flue gas blower 49 makes it possible to adapt the heat output of the furnace 1 to the required amount of heat. The flue gas blower 49 transports flue gas 50 to a flue gas outlet 51, which is connected, for example, to chimneys adjacent to the furnace. As is furthermore evident from FIG. 3, a blower 52, especially a radial blower, is arranged in the region between the fuel container 30 and the base plate 25, which transports ambient air, i.e. fresh air (Arrow 53) to the convection shaft 19 through the pipes 21 of the heat exchanger 22. The fresh air (Arrow 53) is heated by the hot pipes 21, around which flue gases 50 flow, as it flows through the heat exchanger 22, and is given off to the surroundings of the furnace 1 as hot air, through the convection shaft 19.

The flue gases 50 are passed through openings 55 arranged in the rear wall 12, in the region of a cover plate 54 which delimits the combustion chamber in the direction of the convection shaft 19, into the flue gas channel 14 and along the pipes 21 which form the heat exchanger 22, in the direction of a suction opening 56 for the flue gas blower 49. In the region of the flue gas channel 14, a cleaning device 58 which surrounds the pipes 21 at their circumference and is mounted so as to be moved in the direction of the longitudinal expanse of the pipes 21, by means of a handle 57, is arranged. Here, scratcher or scraper elements 59 having a flat profile form flue gas guide plates 60 of a flue gas guide device 61. This is achieved in that several scratcher elements 59 are arranged at a distance from one another in the longitudinal direction of the pipes, with an offset position relative to one another and with reference to the rear wall 12, i.e. rear wall plate 13. These alternately narrow the flow cross-section, i.e. the opening width of the flue gas channel 14 along the rear wall 12, i.e. the rear wall plate 13. As a result, the flue gas 50 is passed around the pipes 21 of the heat exchanger 22 in spiral form, which achieves a high degree of effectiveness of the heat exchanger 22 in heating the fresh air (Arrow 53) which is passed through the pipes 21 to the convection shaft 19 and to the surroundings via the latter, by the blower 52.

In the region of the convection shaft 19, an air guide device 62, formed by curved guide plates, is arranged for deflection of the heated fresh air (Arrow 53). This air guide device 62 causes deflection of the pre-heated fresh air (Arrow 53) to produce advantageous flow. Furthermore, if this is considered advantageous, a proportion of cooler fresh air can be drawn in from an air guide channel 64 formed by the rear wall plate 13 and the container wall 32, via an opening 63 arranged in the rear wall plate 13 in the region of the cover plate 26, as the result of an injector effect in the region of deflection. This additional fresh air can serve as cooling for the screw conveyor 36.

Figure 4:
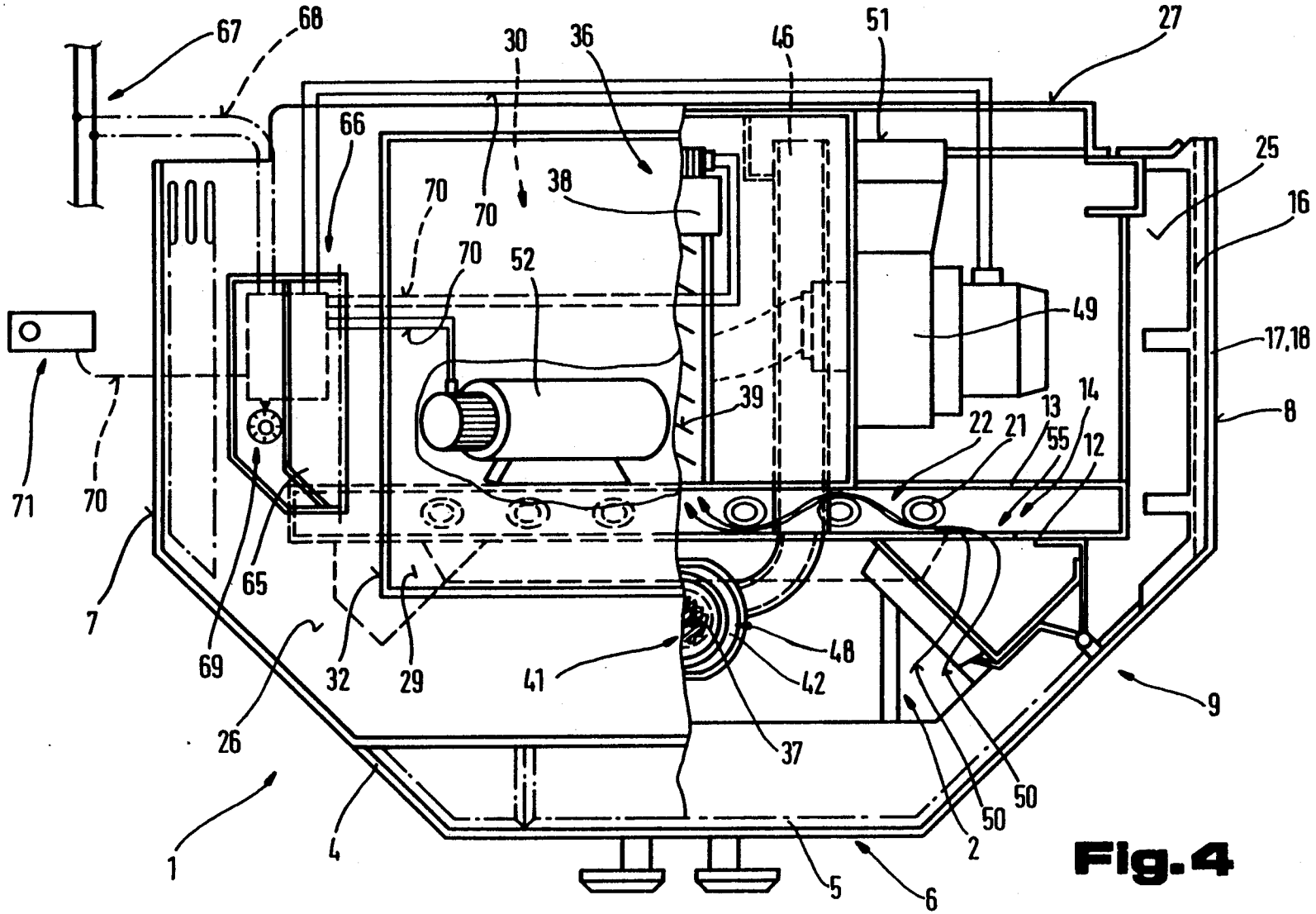
FIG. 4 shows a top view and a partial cross-section of the furnace according to the invention.

In FIG. 4, the furnace 1 is shown in a top view and cut in half in a plane arranged to run horizontally. The side walls 7, 8 are formed by the paneling elements 15, 16, particularly of ceramic, which are held in place by the stop strips 17, 18 which are arranged to run parallel to each other in the vertical direction. The combustion chamber 2 adjacent to the front wall 6 is delimited by the fire space doors 4 and 5 and the rear wall 12.

The charging flap 29 is arranged in the cover plate 26, and an installation groove 66 for a control and regulation device 69 is supplied from an energy source 67 via lines 68. It is installed in the installation groove 66, covered by a flap 65, and is arranged in a region between the side wall 7 and the container wall 32. From the control and regulation device 69, connection lines 70 lead to the blower 52, the flue gas blower 49 and the drive motor 38 of the screw conveyor 36. External data, such as the room temperature, are passed to the control and regulation device 69 via a regulation device 71, e.g. a room thermostat, connected with the control and regulation device 69 via the connection line 70. Device 69 converts external data into commands, such as commands to change the speed of the blowers and the drive motor 38 of the screw conveyor 36, in the control and regulation device, especially an electronic one, which achieves automated and reliable operation of the furnace 1.

The combustion air (Arrow 45) is passed below the burner pan 42 via the air line 46 due to the suction effect of the flue gas blower 49, and to the fireplace 41 with the fuel 37, e.g. pieces pressed from plant material, so-called pellets, through its perforations 48. The flue gas (Arrow 50) which is formed during combustion in the fireplace 41 flows in the direction of the cover plate 54 which delimits the combustion chamber 2 towards the top, and through the openings 55, and is drawn downward, against the thermosyphon effect, causing it to flow around and heat the flue gas channel 14 and the pipes 21. Subsequent to this, lateral deflection of the flue gases and their forced exhaust through the flue gas blower to the outside, via the flue gas outlet 51, takes place.

In FIGS. 5 and 6, the flue gas channel 14 with the heat exchanger 22 are the parts of the furnace 1 shown, with the same reference symbols being used for the same parts. The flue gas channel 14 is formed by the rear wall 12 which connects the side walls 7, 8 and the rear wall plate 13, which are arranged parallel and at a distance 72 from one another. In the vertical direction, the flue gas channel 14 is bounded by a carrier plate 73 in the direction of the cover plate 26 and by a hollow profile 74 of the heat exchanger 22 in the direction towards the base plate 25.

The hollow profile 74 is formed, for example, of a pipe 75 with a square cross-section, in which a side length approximately corresponds to the distance 72, and which is closed on the frontal side and has a length 76, which approximately corresponds to an internal width 77 between the side walls 7, 8. The hollow profile 74 forms a distributor channel 78 of the heat exchanger 22, where the blower 52 for feeding in fresh air (Arrow 53) at a bottom 79 facing the base plate 25, which is fed to the blower 52 via openings 80 arranged at the front wall 6, which open into the in-flow channel 20. On a top 81 facing the carrier plate 73, i.e. the cover plate 26, the pipes 21 are arranged to run in a vertical direction to the cover plate 26. Pipes 21 are preferably welded together, or soldered together, etc. with the distributor channel 78, where openings 82 in the shank of the hollow profile 74 are assigned to the pipes 21.

Over the length 76 of the distributor channel 78, at least several pipes 21 which run parallel to each other are arranged, which have an exit opening 83 in the region of the convection shaft 19. Shaft 19 is formed by the side walls 7, 8 and the cover plate 26 and carrier plate 73. The pipes 21 project through the carrier plate 73 in the direction towards the convection shaft 19 and are connected to move together with the carrier plate 73, i.e. welded or soldered, etc. The carrier plate 73, which separates the flue gas channel 14 from the convection shaft 19 in terms of space, and forms the heat exchanger 22 with the pipes 21 and the distributor channel 78. The distributor channel is brought forward in the direction towards the front wall 6, and is attached to the cover plate 54 which delimits the combustion chamber 2 in the direction of the cover plate 26, preferably screwed on, which causes the heat exchanger 22 to form a unit, ready for assembly, which can be removed from the region of the flue gas channel 14 for maintenance and/or repair work.

In the region between the distributor channel 78 and the carrier plate 73, the pipes 21 are arranged to move in a longitudinal direction, in accordance with a double arrow 85, through bores 84 surrounding the scratcher elements 59, where these have an activation rod 86, which is passed through the cover plate 26 and have the handle 57 for activation. Preferably, the scratcher elements 59 surround several of the pipes 21, where preferably, several scratcher elements 59 are also arranged parallel to one another and distributed over the longitudinal expanse of the pipes 21. Hence, all surface regions of the pipes 21 can be reached by the frontal edges 87 formed by the bores 84 and cleaned of any soot particles or combustion residue, etc., with only a small movement in the direction of the double arrow 85.

Furthermore, the scratcher elements 59 are arranged offset from one another in steps, causing a slot 88 to be formed alternately between the scratcher element 59 and the rear wall 12, i.e. the rear wall plate 13. The frontal edge 89 of the scratcher element 59 which lies opposite the slot 88 rests almost tightly against the rear wall 12, i.e. rear wall plate 13 when this happens. With this offset arrangement of the scratcher elements 59, the flue gases 50 which flow from the combustion chamber 2 into the flue gas channel 14 via the openings 55 are passed around the pipes 21 of the heat exchanger 22 in spiral form, in the direction of the suction opening 56, through which the flue gases 50 flow towards the flue gas blower 49.

The pipes 21 of the heat exchanger 22 are brought together in groups of three in the embodiment shown, and arranged symmetrical to a center axis 90, where the pipes 21 lying closest to the center axis 90 have a greater distance from one another than the distances of the pipes 21 brought together in groups. As a result, a clear chamber for the ejection chute 40 which crosses through the flue gas channel 14 in the direction towards the combustion space 2 is formed along the center axis 90. When forming the pipes 21, which are made of a material with good heat conductivity, e.g. a copper alloy, a structure advantageous for flow, especially in the region of the openings 82 of the distribution channel 78, must be observed. It is practical in this connection to widen the pipes 21 to a square cross-section, which results in a large cross-section, advantageous for flow, for entry of the fresh air (Arrow 53) into the pipes 21 from the distribution channel 78 and this in a low noise level. This also achieves low output for the blower 52, which makes it possible to operate the furnace 1 in particularly efficient manner.

Of course, it is also possible to structure the pipes 21 of the heat exchanger 22 with a square cross-section or a rectangular cross-section with rounded edges, or in similar manner, over their entire longitudinal expanse, in order to achieve a large surface for heat exchange, on the one hand, and a large flow cross-section, on the other hand. This results in a high air throughput with a reduced flow velocity, which prevents a draft effect and the nuisance of flow and motor noises.

Both for the degree of effectiveness of the heat exchanger 22 and for the useful life of the pipes 21, it has been proven advantageous to form these of copper alloys with a nickel-plated surface. Of course, other materials, such as specialty steel or stainless steel, can also be used for the pipes 21 of the heat exchanger 22.

Figure 7:
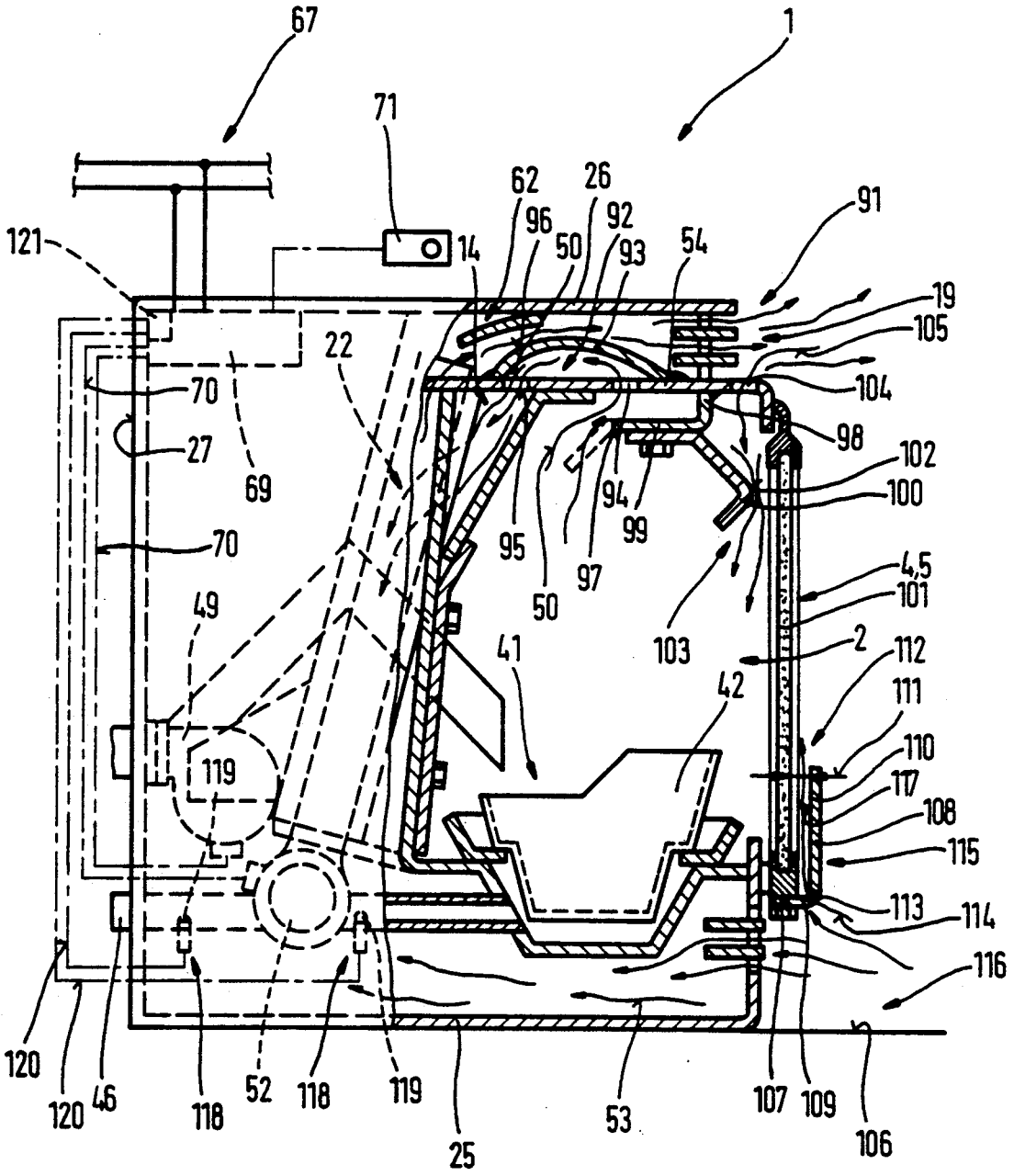
FIG. 7 shows a side view, in partial cross-section, of another embodiment of the furnace according to the invention.

In FIG. 7, another embodiment of the furnace 1 is shown, where the same reference symbols are used for the same parts. In this embodiment, an overflow channel 92 is formed by a housing 93 arranged on the cover plate 54 of the combustion chamber 2, in the convection shaft 19, in the region between the air guide device 62 and an out-flow opening 91. This housing includes openings 94 arranged in the cover plate 54, and connection openings 95 to the flue gas channel 14 provided with the heat exchanger 22, arranged at a distance from these openings in the direction towards the rear 27.

By means of a concave curved structure of the housing 93, a larger surface and therefore more effective heating is achieved for the circulating air flowing out of the convection shaft 19 by the flue gas 50. At the same time, a surface 96 of the housing 93 acts as an air guide device 62. The opening 94 in the cover plate 54 is covered by an L-shaped profile 97 in the direction of the combustion chamber 2, which is connected with the cover plate 54 at one shank 98, particularly by being welded. The other shank 99 of which projects in the direction of the rear 27, running approximately to the cover plate 54. As is further shown with a broken line, the shank 99 can be structured angled or bent in the direction of the base plate 25, for deflection of the flue gases 50 to promote flow.

In the direction of the burner pan 42, an approximately J-shaped profile 100 is attached to the shank 99, especially screwed onto it. Profile 100 projects beyond the shank 98 in the direction of the fire space doors 4, 5, which forms a slot-shaped opening 103 for fresh air (Arrow 105) passed through perforations 104 in the cover plate 54, into the combustion chamber 2, together with a surface 102 lying next to the door 4, 5 or a glass pane 101 set into the fire space doors 4, 5. This fresh air (Arrow 105) passed into the combustion chamber 2 flows along the glass panes 101 in the direction of the base plate 25 and causes the glass panes 101 to be kept free from combustion residues, soot, etc. In the region of the burner pan 42, this fresh air is passed to the fireplace as secondary air for combustion, as a subsequent step.

At the fire space doors 4, 5, an L-shaped profile 108 is attached to a bottom 107 facing a standing surface 106 of the furnace 1, with one shank 109, especially screwed on, the other shank 110 of which is arranged parallel to the glass pane 101 and projects in the direction of the cover plate 26. The shank 110 is located at a slight distance 111 from the glass pane 101, which causes a channel 112 to be formed for cooling air (Arrow 114) passed in through openings 113 in the shank 109 for cooling of the glass pane 101. At the same time, the profile 108 projecting in the distance 111 from the glass pane 101 and in the direction of the cover plate 26 forms a heat shield 115, which protects a base region 116 of the standing surface 106 against overheating due to heat radiation from the fireplace 41. In order to prevent overheating of the heat shield 115, it is particularly practical to structure an interior surface of the profile 108 which faces the combustion space 2 with a radiation-reflecting surface 117.

Sensors 118 are arranged at the air line 46 to supply the fireplace 41 with fresh air, which project into the unobstructed pipeline cross-section with sensor elements 119. The sensors 118 are connected with an electronic measurement device 121 of the control and regulation device 6 via lines 120. By means of the sensors 118 and the evaluation electronics of the measurement device 121, a regulation of the fresh air supplied is adapted to the combustion output of the furnace 1 in each case, and is achieved by means of a comparison of reference/actual air flow. This comparison of reference/actual air flow takes place in such a way that the sensor elements 119 are structured as thermocouples. One of the two thermocouples is heated and the determination of the amount of air passed to the combustion chamber is now carried out. Thus, the cooling of this thermocouple by the amount of air moved past it is determined. If the flow velocity corresponds to the reference value at the pre-defined cross-section, which remains the same, an exactly pre-defined amount of air is supplied to the furnace. This amount of air is completely independent of the outside air pressure in each case, and therefore also of the sea level of the installation site.

With this, however, it can also be determined, on the basis of the heated resistor, whether the amount of air transported is greater than or is lesser than the desired reference value. If the resistor is at a higher temperature than would be the case at the air flow reference valve, then the air flow velocity should be increased. If the resistor is at a lower temperature than the pre-defined reference valve temperature, then the air flow velocity should be decreased, in order to supply the desired amount of air to the combustion chamber.

In order to precisely adjust and regulate this amount of air, which allows for a precise combustion air feed and thus results in a precise regulation of the combustion process, to the operating condition or installation site in each case, the temperature of the fresh air drawn in also has to be taken into consideration. For this purpose, another sensor 118, and another sensor element 119, is used, which is formed by a thermocouple, in other words, by a resistor. If the air temperature is cooler than the reference valve, more rapid cooling of the heated resistor, and the sensor element 119, takes place. Depending on the air temperature determined, the reference temperature of the heated resistor must be defined, in order to ensure that the amount of air supplied to the combustion space corresponds to the output level set in each case. In order to allow regulation of the combustion process over a large regulation range, these sensors can be designed for flow velocities from 0.5 m/sec to 5 m/sec, for example. Preferably, the velocity of the air flow is 0.8 to 3.2 m/sec. The flow velocity monitored with the heated resistor or sensor element 119 in each case is guided by the output level of the furnace which is set, since the amount of air required at higher heating output is greater than at a lower heating level, for example.

As a function of the flow velocities determined with the sensors 118, and the sensor elements 119, and taking into consideration the heating output set, the flow velocity is then changed smoothly, without increments.

The advantage of this solution also lies in the fact, however, that slight leaks in the combustion chamber are compensated for with this amount of air and the regulation thereof. This is carried out in such a way that any air deficiency due to leaks results in a lower combustion output, which causes the desired combustion temperature for the set output level not to be reached. Thus, the next higher output level is automatically switched on via the control and regulation device 69.

Another advantage to regulating the amount of air on the basis of the flow velocity is that in order to change the amount of air supplied, all that is necessary is to change the rpm's of the flue gas blower 49. For example, if the partial vacuum formed in the combustion chamber 2 is to be increased, then the flow velocity of the fresh air drawn in (Arrow 53) is increased. If the flow velocity is too great, the rpm's of the flue gas blower 49 are correspondingly reduced. This closed control circuit between the sensors 118 and the flue gas blower 49 is created via the control and regulation device 69. For example, it is also possible in this connection to provided a sensor or a sensor element 119 in the convection shaft 19, for example a thermocouple, with which the air temperature of the heated fresh air is determined. This will reinforce the combustion process accordingly, if the output of the furnace is insufficient.

If deviations are determined by the measurement devices 121, the control and regulation device 69 activates a control circuit for the corresponding rpm change of the drive of the flue gas blower 49, the speed of which can be controlled.

With the comparison of reference/actual value which is achieved by the measurement results of the sensors 118, the flow rate of fresh air fed into the combustion chamber 2 can thus be monitored in accordance with the operating condition in each case. This flow rate can be adjusted via the rpm regulation, even if an increased flow resistance exists in the air line 46 when the fresh air is fed, for example. This particularly results in automatic adjustment of the rpm level of the flue gas blower 49, which takes different operating conditions, especially during start-up of the furnace 1, into account. Furthermore, the drive means for the blower 52 for the convection air and of the screw conveyor 36 are structured so their speed can be controlled, in order to regulate the amount of air and the amount of fuel in accordance with a desired operating condition of the furnace 1.

Figure 8:
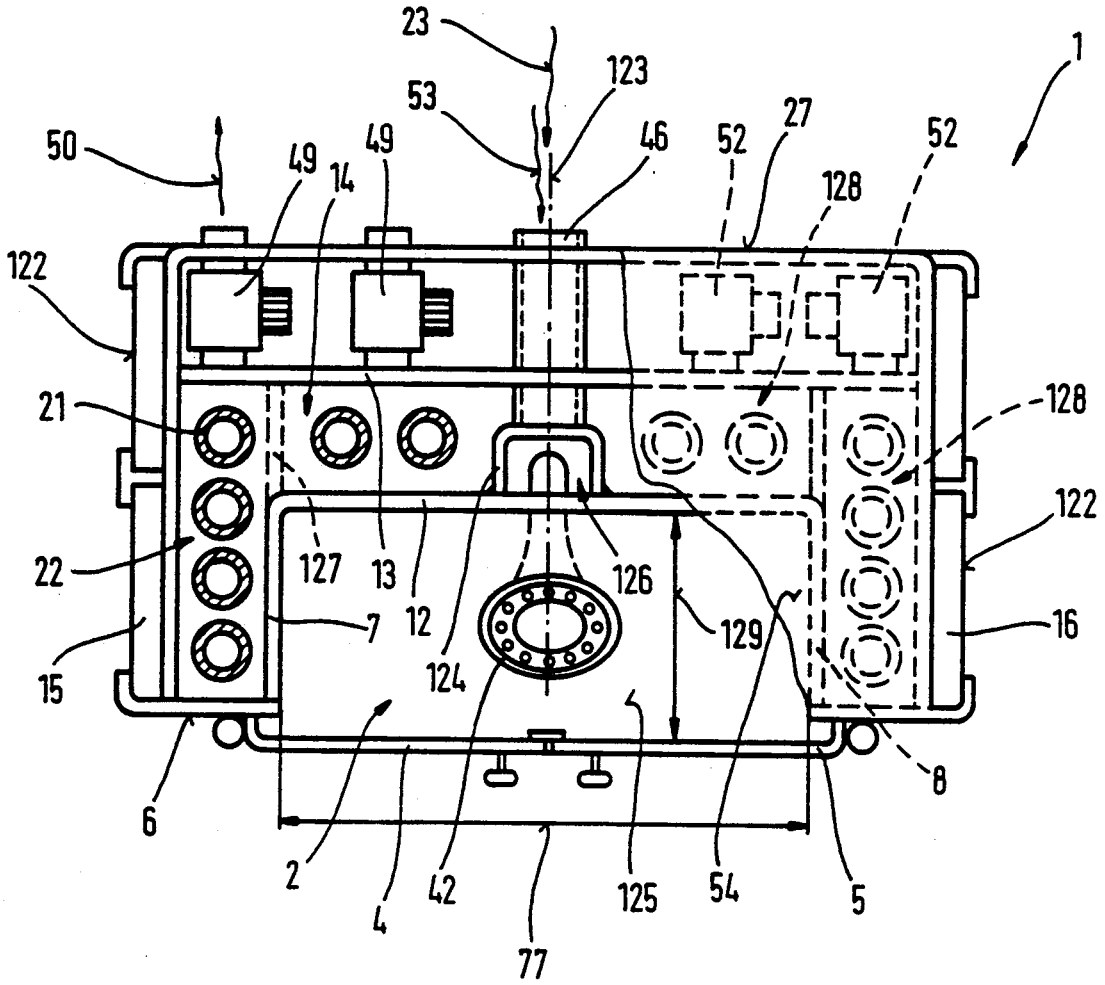
FIG. 8 shows a top view, in partial cross-section, of another embodiment of the furnace according to the invention.

FIG. 8 shows another embodiment of the furnace 1, where the same reference symbols are used for the same parts. Here, the combustion chamber 2 is surrounded by the flue gas channel 14, which is structured in a C-shape, and channel 14 surrounds rear wall 12 and side walls 7, 8 of chamber 2. This channel 14 is delimited by the rear wall plate 13 in the direction of the rear 27 and by the paneling elements 15, 16 in the direction of the side surfaces 122. In the region of the axis of symmetry 123, a U-shaped profile 124 projecting in the direction of the flue gas channel 14, for an air shaft 126 which extends approximately from the region of the cover plate 54 into the region of a burner plate 125 is arranged at the rear wall 12, especially welded together with it to form a gas seal. The fresh air (Arrow 53) is passed to the air shaft 126 via the air line 46 and heated while it flows in the direction of the burner pan 42 arranged in the burner plate, by the flue gases which flow through the flue gas channel 14. In the flue gas channel 14, the heat exchangers 22 formed by the pipes 21 are located, which surround the combustion chamber 2 at the rear wall 12 and the side walls 7, 8 due to the structure of the flue gas channel 14. As is shown with a broken line, for example, it is possible to divide the flue gas channel 14 into several independent shafts 128 with separating plates 127, and to assign a heat exchanger 22 to each shaft 128. Furthermore, it is possible to assign the flue gas blower 49 for the flue gas 50 to the flue gas channel 14 as a whole or to each shaft 128 of the flue gas channel 14. Likewise, it is also possible to assign the blower 52 to the heat exchangers 22 as a whole or to each heat exchanger 22. With this structure, it is possible to achieve a sensitive output control even with combustion chambers 2 that have a large volume, or if the side ratios of the width 77 to a depth 129 of the combustion space 2 is disadvantageous.

The ambient air designated with an arrow 23, i.e. the fresh air shown with an arrow 53, can be taken from the heated space, in other words from the ambient air, for example, or can be supplied from outside the building or a different space than the heated space, via a separate pipeline. If necessary, it can also prove to be practical to change the air intake site, or to change the proportion of air which is taken from the heated space, relative to the proportion which is supplied from a different space or from outside the building itself.

Figure 9:
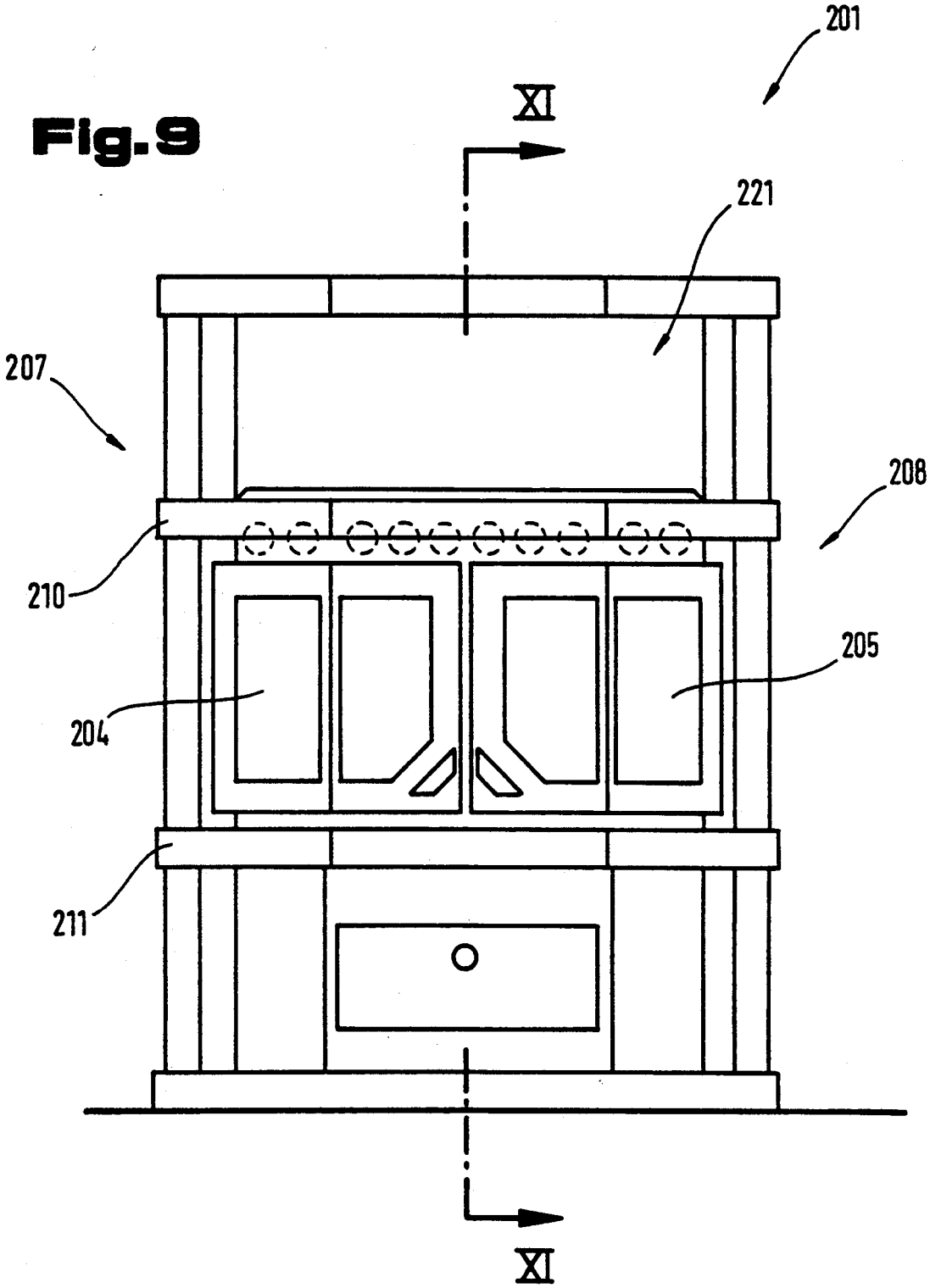
FIG. 9 shows a front view of another furnace according to the invention.
Figure 10:
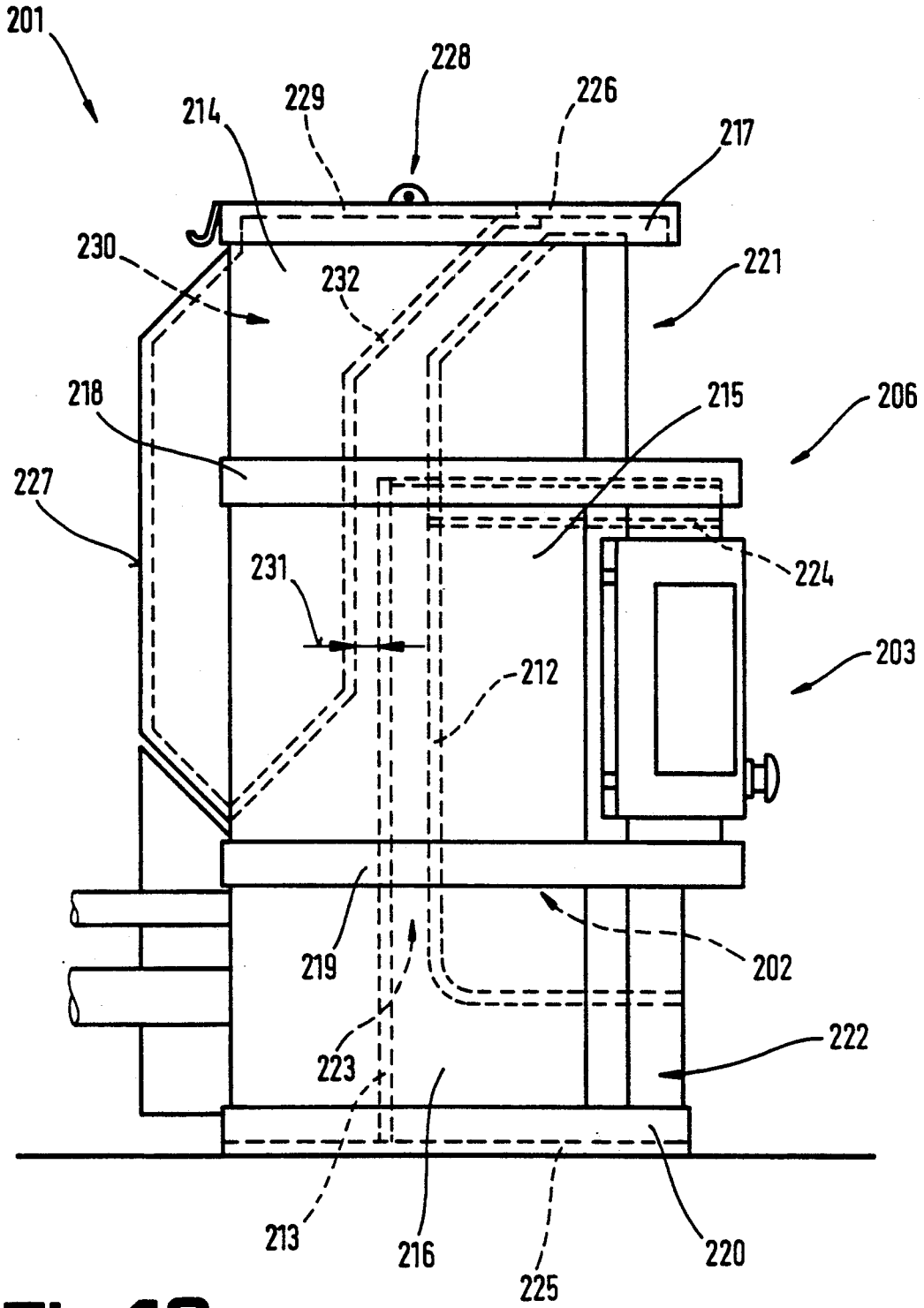
FIG. 10 shows a side view of the furnace in FIG. 9.
Figure 11:
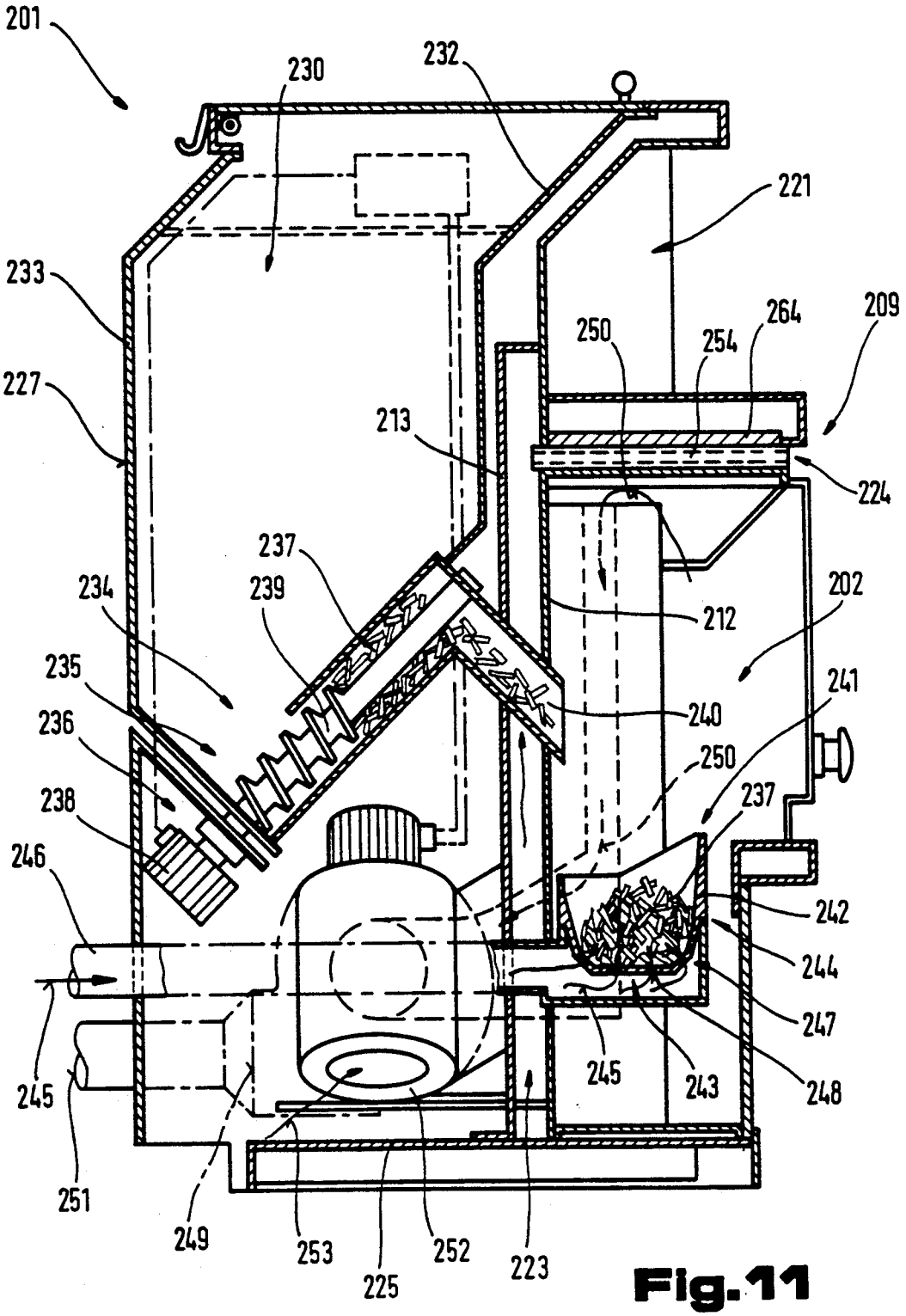
FIG. 11 shows a cross-section along lines XI—XI of FIG. 9 of another furnace according to the invention.

FIGS. 9, 10 and 11 show a furnace 201 which has a combustion chamber 202, which is accessible via an operating and/or cleaning opening 203, which can be closed off via fire space doors 204, 205. The operating and/or cleaning opening 203 is arranged in a front wall 206 of a one-piece component 209 which also forms side walls 207 208. The component 209 has a trapezoidal or C-shaped cross-section and has assembly strips 210, 211 running parallel to the front wall 206. The combustion chamber 202 is furthermore closed off by a rear wall 212. At a slight distance from the rear wall 212, a rear wall plate 213 of the convection mantle is attached. In the region of the side walls 207, 208, the convection mantle is formed by paneling elements 214, 215 and 216, which are arranged between stop strips 217 to 220. Above the combustion chamber 202, a warming or baking compartment 221 is located, and below this, a circulation space 222 for convection air is located. Space 222 continues in the vertical direction in a convection space 223 between the rear wall 212 and the rear wall plate 213. Space 223 is connected with the ambient air by means of pipes 224 which cross through the combustion chamber 202 in the direction of the front wall 206.

A further delimitation of the furnace 201 is formed by a base plate 225, a cover plate 226 and a rear 227. At the cover plate 226, a charging flap 229 is located and which forms the vertical delimitation of the furnace 201 and can be flipped open at the cover plate 226 via a hinge arrangement 228, which covers the fuel container 230 in the closed state. The fuel container 230 is formed by a container wall 232 connecting the side walls 207, 208 of the furnace 201 and arranged at a slight distance 231 in front of the rear wall plate 213 of the combustion space 202, and a container wall 233. A base region 234 of the fuel container 230 is V-shaped and structured to narrow in the direction of the base plate 225, which causes an inclined plane to be formed in the direction of an intake opening 235 of a screw conveyor 236 approximately at the deepest point of the base region 234. In this region, a particulate fuel 237 is taken in by a screw conveyor 239 driven by a drive motor 238, and transported upward in the direction of a pipe-shaped ejection chute 240. The ejection chute 240 is arranged at a slant in the direction of the combustion chamber 202, and projects through the rear wall plate 213 and the rear wall 212, which causes the fuel 237 to be passed into the combustion chamber 202 under the influence of gravity. This is after the fuel has reached the highest point of the screw conveyor 236, and fuel is deposited into a burner pan 242 which forms the fireplace 241.

The burner pan 242 is inserted in a box-shaped holder chamber 243, via a sealing arrangement 244 formed on the burner pan 242 and the holder chamber 243. The holder chamber 243 is connected with the ambient air in the direction of the rear 227, for the feeding of combustion air (Arrow 245) through a pipeline 246. The combustion air (Arrow 245) flows to the fireplace 241 through perforations 248 distributed in the surface regions 247 of the burner pan 242 facing the holder chamber 243. Therefore, this combination air flows into the particulate fuel 237, where a flue gas blower 249 generates a partial vacuum in the combustion chamber 202 by drawing off the flue gases (Arrow 250) causing the feed of combustion air (Arrow 245) to necessarily be increased. This effect can be adapted to the requirements regarding heat output of the furnace 201 by changing the speed of rotation of the flue gas blower 249. The flue gas blower 249 passes the flue gas (Arrow 250) to a flue gas outlet 251, which is connected, for example, to chimneys present in the construction side. As is furthermore evident from FIG. 11, a blower 252, especially a radial blower, is arranged in the region between the fuel container 230 and the base plate 225, which passes fresh air (Arrow 253) to the convection space 223. The fresh air (Arrow 253) is heated as it flows along the rear wall 212 of the combustion chamber 202, and is given off to the surroundings of the furnace 201 as hot air, through convection pipes 254.

Figure 12:
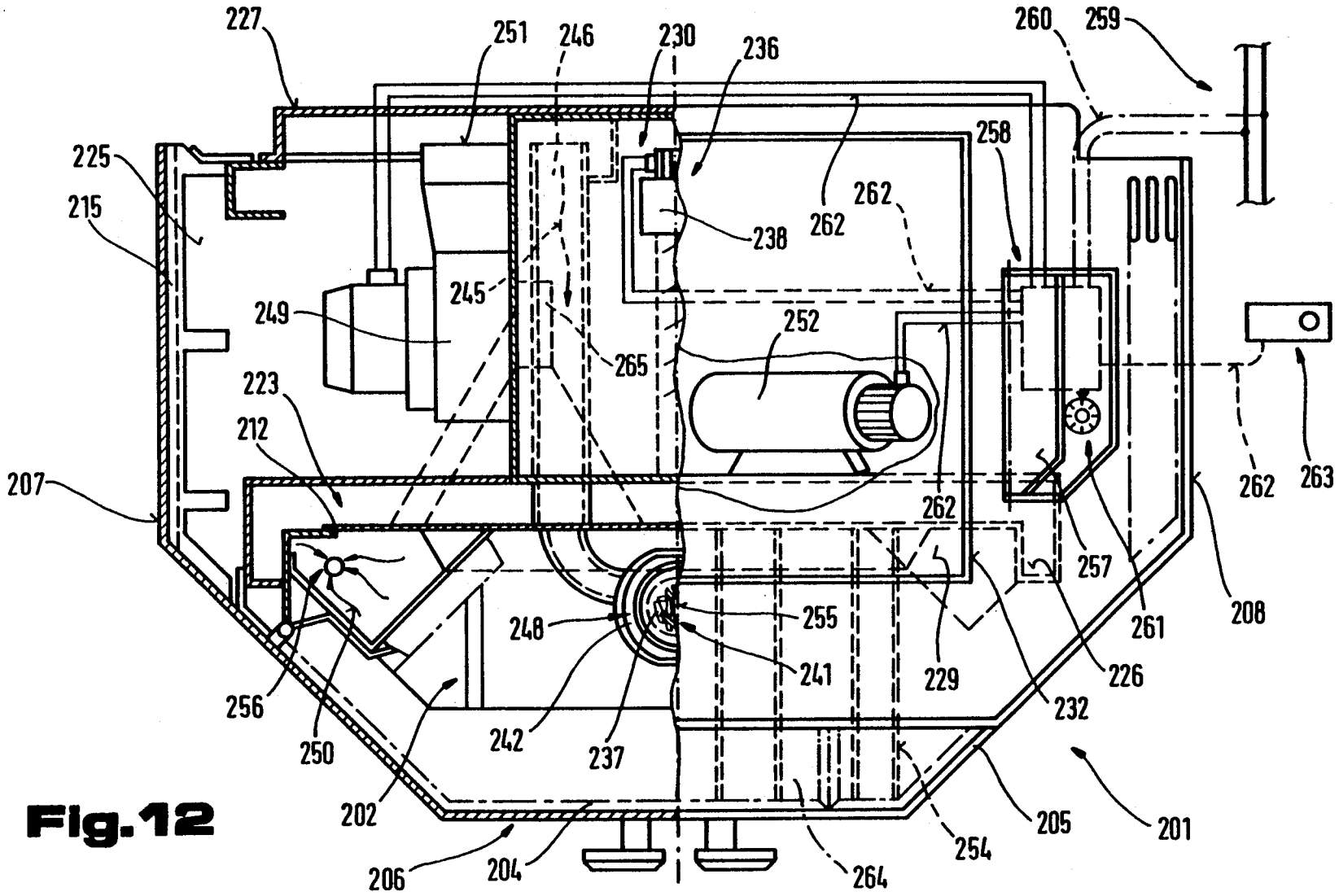
FIG. 12 shows a top view and in partial cross-section of the other furnace according to the invention.

In FIG. 12, the furnace 201 is shown in a top view and in a half-section view in a plane arranged to run horizontally. The side walls 207, 208 are formed by the paneling elements 214, 215, 216, particularly of ceramic, which are held in place by the stop strips 217, 218, 219, 220 which are arranged to run parallel to each other, at a distance in the vertical direction. The combustion chamber 202 located near the front wall 206 is delimited by the fire space doors 204 and 205 and the rear wall 212. There are channels 256 for the feed of flue gases (Arrow 250) to the flue gas blower 249 arranged close to the base plate 225 and arranged in mirror-image form relative to a plane of symmetry 255, delimited from the combustion chamber 202 and crossing through it in a vertical direction. The combustion chamber 202 is surrounded in U-shape in the direction of the rear 227 of the furnace 201, by the shaft-shaped convection space 223, which results in there being a great radiation surface for heat transfer to the convection air.

In the region between the convection space 223, i.e. a sheet-metal profile delimiting the convection space 223, and the rear 227 of the furnace 201, the fuel container 230 is arranged, and between the latter and the base plate 225, the flue gas blower 249 and the blower 252 for the convection air are located. The charging flap 229 is located in the cover plate 226. An installation groove 258 for a control and regulation device 261 is supplied from an energy source 259 via lines 260 and installed in the installation groove 258, covered by a flap 257, is arranged in a region between the side wall 208 and the container wall 232. From the control and regulation device 261, connection lines 262 lead to the blower 252, the flue gas blower 249 and the drive motor 238 of the screw conveyor 236. External data, such as the room temperature, are passed to the control and regulation device 261 via a regulation device 263, e.g. a room thermostat, connected with the control and regulation device 261 via the connection line 262. This external data is converted into commands, such as commands to change the speed of the blowers and the drive motor 238 of the screw conveyor, in the control and regulation device, especially an electronic one, which achieves automated and reliable operation of the furnace 201.

The combustion air (Arrow 245) is passed below the burner pan 242 via the air line 246 due to the suction effect of the flue gas blower 249, and into the fireplace 241 with the fuel 237, e.g. pieces pressed from plant material, so-called pellets, through its perforations 248. The flue gas escaping from the fireplace 241 flows in the direction of the cover plate 264 which delimits the combustion chamber 202 towards the top, and through the openings, causing it to flow around and heat the convection pipes 254. Subsequent to this, lateral deflection of the flue gases (Arrow 250) takes place, and their forced exhaust in the channel 256 and exhaust through an automatic pressure control device 265 which is placed in front of the flue gas blower 249 into the flue gas outlet 251 takes place.

In FIG. 13, the pressure regulation device 265 placed in front of the flue gas blower 249 in the direction of the combustion chamber 202 and the channel 256 for the flue gas (Arrow 250) is shown. A flap 269 is assigned to an opening 266 in the surface region of a collector channel 267, which region runs at a slant. Flap 269 pivots around an axis 268 arranged parallel to the base plate 225, in the direction of the flue gas blower 249, the overall center of gravity of which demonstrates a greater distance 270 from the base plate 225 than a distance 271 of the axis 268 from this plate. In the inactivated state, the flap 269 closes the opening 266, which causes the air circulation from the channel 256 and therefore from the combustion chamber 202 to the flue gas outlet 251 to be interrupted.

If a suction pressure is exerted by the flue gas blower 249 in the operating state, the flap 269 pivots in the direction of an arrow 272. This causes the opening 266 to be released as a function of the size of the suction pressure, up to a maximum value at an approximately vertical position of the flap 269. This results in different pressure conditions in the flow direction in front of and behind the flap 269, as a function of the position of the flap. The return moment of the flap 269 furthermore becomes smaller in the direction of the position of the flap 269 drawn with broken lines, because of the arrangement of the center of gravity of the flap 269 with reference to its axis 268, as the opening position increases. This results in the desirable effect that the pressure difference is smaller at a high suction output of the flue gas blower 249 and therefore at a high output requirement of the furnace 201 than at a pre-selected small output requirement of the furnace 201. The pressure difference is in a range between a minimum of approximately 0.5 mb and a maximum of 1.2 mb.

In FIGS. 14 and 15, the holder chamber 243 is shown with the burner pan 242 held in it. The burner pan 242 preferably has a circular cross-section assigned to the sealing device 244, with which the burner pan 242 rests on the holder chamber 243, forming a seal. In the surface regions 247 facing the holder chamber 243, the burner pan has the perforations 248 for the combustion air (Arrow 245) passed in via the pipe line 246. From the sealing arrangement 244, in the direction of the combustion space 202, the burner pan 242 is formed by a deflector wall 273, a rear wall 274 and cross-walls 275, 276 connecting these. Preferably, the height 277 of the deflector wall 273, projecting beyond the sealing arrangement 244, is greater than the height 278 of the rear wall 274. Accordingly, the cross-walls 275, 276 also demonstrate a height gradation in their progression connecting the deflector wall 273 and the rear wall 274. The cross-section of the region of the burner pan 242 projecting beyond the sealing arrangement 244, formed by the deflector wall 273, the rear wall 274 and the cross-walls 275, 276 preferably has an oval or elliptical cross-section. However, a circular cross-section which widens conically from the sealing arrangement 244 in the direction of the combustion chamber 202, as well as a square or rectangular cross-section with rounded corners, is possible just as well. Furthermore, the burner pan 242 can be formed as a cast structure. The perforations 248 can be arranged uniformly or non-uniformly in a base plate 279 and/or in the inclined surface regions 247 of the burner pan 242, and can be of equal or non-equal size. Of course it is also possible to make the burner pan 242 of a particularly heat-resistant sheet metal, using a welded construction.

While several embodiments of the present invention have been shown and described, it is to be understood that many changes and modifications may be made thereunto without departing from the spirit and scope of the invention as defined in the appended claims.

What is claimed is:

1. A furnace for solid fuel combustion material comprising a fuel container for the combustion material;

a combustion chamber having at least one rear wall, and having a width and a height;

a holder pan for the combustion material located in the combustion chamber;

a transport device for the combustion material between the holder pan and said fuel container for the combustion material;

means defining a convection zone surrounding the combustion chamber;

a convection mantle for closing off the convection zone towards the outside;

a blower arranged between the ambient air and the convection zone;

a flue gas line;

a flue gas blower positioned between the combustion chamber and said flue gas line;

a flue gas channel located in front of said at least one rear wall of the combustion chamber on the side facing away from the combustion chamber, and extending over at least part of a width and a height of the combustion chamber;

a cover plate and a base plate;

said flue gas channel having an upper end region, and at said upper end region of the flue gas channel, which region faces said cover plate, is connected with at least one opening connecting said flue gas channel with the combustion chamber; and said flue gas channel having a lower end region, and in the lower end region, which lower end region faces said base plate, said flue gas channel is connected with a flue gas outlet, which is connected to said flue gas blower via at least one suction opening; and a heat exchanger located within said flue gas channel, with fresh air flowing through said heat exchanger in a direction countercurrent to the flow direction of a flue gas.

2. The furnace according to claim 1, further comprising a blower for the fresh air and connected to the front of the heat exchanger.

3. The furnace according to claim 2, wherein the heat exchanger is formed by hollow pipes which are arranged to run parallel to one another and through which fresh air flows.

4. The furnace according to claim 3, wherein the hollow pipes have a cross-section widened approximately to a square, at least in the region of an in-flow opening for the fresh air.

5. The furnace according to claim 4, wherein the pipes of the heat exchanger are formed of a copper alloy, stainless steel, steel, or a metal having one surface which is nickel-plated.

6. The furnace according to claim 1, wherein the heat exchanger has a flue gas guide device comprising flue gas guide plates which delimit the flue gas channel in its opening width from opposite sides, and said flue gas guide plates being spaced apart in the flow direction.

7. The furnace according to claim 6, wherein the flue gas guide plates comprise scratcher elements of a cleaning device guided along pipes of the heat exchanger.

8. The furnace according to claim 7, further comprising said heat exchanger having a fresh air outlet;

said convection shaft having an out-flow opening;

an air guide device positioned between the outlet of the fresh air from the heat exchanger and the out-flow opening out of the convection shaft; said air guide device located in the region wherein there is at least one opening for fresh air brought in from the ambient air.

9. The furnace according to claim 8, further comprising an air guide channel;

the opening for the fresh air feed is connected with said air guide channel running parallel to the heat exchanger; and a screw conveyor for said solid fuel located in said air guide channel.

10. The furnace according to claim 9, further comprising an over-flow channel for the flue gas comprising a housing located in the region of the convection shaft.

11. The furnace according to claim 10, further comprising a cover plate for the combustion chamber; and wherein the over-flow channel forms a flow connection with the combustion chamber via openings arranged in the cover plate of the combustion chamber, and with the flue gas channel via connection openings.

12. The furnace according to claim 11, further comprising an L-shaped profile connected with the cover plate and located in front of the opening in the direction of the combustion chamber as a guide device for the flue gas.

13. The furnace according to claim 12, further comprising fire space doors having a glass pane;

at the L-shaped profile, a J-shaped profile is located and projecting in the direction of the fire space doors, which forms a slot-shaped opening with a surface of the J-shaped profile and the glass pane of the fire space doors.

14. The furnace according to claim 13, wherein perforations are arranged in the cover plate in the region of the fire space doors, which form a flow connection between the ambient air and the combustion chamber for secondary air.

15. The furnace according to claim 14, wherein an opening width of the slot-shaped opening is structured to be adjustable via an adjustment device of the J-shaped profile.

16. The furnace according to claim 15, wherein the fire space doors have a bottom side; and further comprising a heat shield arranged in front of the glass pane in the region of said bottom side of the fire space doors.

17. The furnace according to claim 1, further comprising sensors with sensor elements projecting into the clear cross-section of the air line comprising a thermocouple formed of a heated resistor, and a thermocouple formed of a non-heated resistor, are arranged in an air line for the feed of fresh air to a fireplace.

18. The furnace according to claim 17, further comprising a control and regulation device;

a control circuit connected to said control and regulation device;

wherein a sensor element formed by a heated resistor is arranged in an air line for the feed of fresh air to a fireplace, arranged in front of a flue gas blower;

an output signal of said sensor element is passed on to said control and regulation device, to which a motor of the flue gas blower is connected via said control circuit; and an output signal of said sensor element is passed on to said control and regulation device, to which a motor of the blower is connected via said control circuit; and a reference temperature for the sensor element is determined as a function of the set heating output, and this reference temperature is changed as a function of the air temperature of the incoming fresh air.

19. The furnace according to claim 18, wherein the amount of transported air, as determined by the rpm's of the flue gas blower, is increased by the control and regulation device if an actual temperature of the heated resistor of the sensor element is less than the reference temperature, and the rpm's are decreased if the temperature is greater than the reference temperature.

20. The furnace according to claim 19, wherein a measurement device in a control and regulation device is assigned to the sensors.

21. The furnace according to claim 20, further comprising drive means for the flue gas blower;

drive means for the screw conveyor;

said drive means for the flue gas blower and said drive means for the screw conveyor are structured so that each's speed of rotation is infinitely adjustable.

22. The furnace according to claim 1, wherein openings which form a flow connection between the combustion chamber and the flue gas channel and the flue gas blower, the connection openings and suction openings are formed by a plurality of connection openings arranged at a distance from one another in the direction of a width of the furnace.

23. The furnace according to claim 22, wherein the connection openings are arranged approximately in the region of the pipes of the heat exchanger.

24. The furnace according to claim 23, further comprising an air shaft for passing fresh air to the fireplace; and said air shaft is arranged in the flue gas channel in the region between at least two heat exchangers formed by the pipes.

25. The furnace according to claim 24, wherein the flue gas channel surrounds the combustion space in U-shape at its rear wall and side walls.

26. The furnace according to claim 25, further comprising several heat exchangers formed by the pipes located in the C-shaped flue gas channel; and a common blower for fresh air for all of the heat exchangers, or one which can be regulated independently for each heat exchanger.

27. The furnace according to claim 26, wherein the U-shaped flue gas channel is formed by several shafts separated from one another; and a flue gas blower is assigned to each channel.

28. The furnace according to claim 27, wherein a primary air line in the combustion chamber opens into a holder chamber, which is provided with a frontal surface structured as a sealing surface;

said sealing surface facing a burner pan for burning off the fuel; said burner pan resting on said sealing surface to form a seal with a sealing surface on its circumference;

said burner pan having perforations for the primary air in the surface region facing the holder chamber; and an automatic pressure regulation device positioned between the combustion chamber and the flue gas blower.

29. The furnace according to claim 28, wherein the perforations have a cross-sectional area which becomes smaller with a decreasing distance to the sealing surface.

30. The furnace according to claim 29, wherein the perforations are evenly distributed over the surface region facing the holder chamber.

31. The furnace according to claim 28, wherein the perforations in a base plate of the burner pan arranged in the holder chamber are larger than the perforations in side walls which run at a slant to the base plate.

32. The furnace according to claim 31, wherein the base plate is at a slant to a standing surface of the furnace comprising a plane holding an incoming line for the primary air, and an end plate of the holder chamber.

33. The furnace according to claim 32, wherein the end plate of the holder chamber and the base plate of the burner pan are aligned parallel to each other and run at a slant to a standing surface of the furnace.

34. The furnace according to claim 33, further comprising a feed channel for the fuel having an injection chute with an intake opening; and wherein the burner pan comprises a deflector wall projecting beyond the sealing surface of the pan in the direction of the combustion chamber, cross-walls delimiting the deflector wall and a rear wall facing the intake opening.

35. The furnace according to claim 34, wherein the deflector wall projects beyond the rear wall and, if necessary, at least parts of the cross-wall in the direction of the combustion chamber, and beyond the sealing surface of the holder chamber approximately parallel to a vertical axis of symmetry of the burner pan.

36. The furnace according to claim 35, further comprising said deflector wall having a height; said rear wall having a height; and said cross-wall having a height;

wherein the height of the deflector wall, the rear wall and the cross-wall projecting beyond the sealing surface of the holder chamber is different for each wall.

37. The furnace according to claim 36, wherein the burner pan has a circular cross-section in a plane running parallel to the base plate.

38. The furnace according to claim 37, wherein the deflector wall, the rear wall and the cross-walls of the burner pan are delimited by an oval or elliptical cross-sectional area in the direction of the combustion chamber.

39. The furnace according to claim 38, further comprising a pressure regulation device;

a collector channel for the pressure regulation device;

wherein channels for the flue gas are positioned between the combustion chamber and said collector channel for pressure regulation device; and connected with the flue gas blower.

40. The furnace according to claim 39, wherein the collector channel has a partition, and said partition has an opening and;

wherein the pressure regulation device comprises a flap forming a tight seal over said opening of the partition of the collector channel, which flap can pivot around an axis.

41. The furnace according to claim 40, further comprising a base plate; and wherein the flap has an incline relative to the base plate of approximately 45° to 70° in its position sealing the opening.

42. The furnace according to claim 41, wherein in its open position, the flap has an angle of less than or equal to 90° relative to the base plate.

43. The furnace according to claim 42, wherein the flap has an overall center of gravity; and a distance of the overall center of gravity of the flap which can pivot around the axis from the base plate is greater in the open position than in the closed position.

44. The furnace according to claim 43, wherein said flap comprises a sealing device for the partition.

* * * * *